US008677773B2

(12) United States Patent
Lee et al.

(10) Patent No.: US 8,677,773 B2
(45) Date of Patent: Mar. 25, 2014

(54) REFRIGERATOR HAVING A VARIABLE CAPACITY HEATER

(75) Inventors: Youn-Seok Lee, Seoul (KR); Kyeong-Yun Kim, Seoul (KR); Su-Nam Chae, Seoul (KR); Min-Kyu Oh, Seoul (KR); Jang-Seok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 588 days.

(21) Appl. No.: 12/690,130

(22) Filed: Jan. 20, 2010

(65) Prior Publication Data

US 2010/0192608 A1 Aug. 5, 2010

(30) Foreign Application Priority Data

Jan. 30, 2009 (KR) ..... 10-2009-0007748

(51) Int. Cl.
*F25D 21/06* (2006.01)
*F25D 25/00* (2006.01)
*A47F 3/04* (2006.01)

(52) U.S. Cl.
USPC ..... 62/275; 62/248; 62/377; 62/331

(58) Field of Classification Search
USPC ..... 62/275, 331, 3.1–3.2, 248, 377
See application file for complete search history.

(56) References Cited

U.S. PATENT DOCUMENTS 4,458,137 A * 7/1984 Kirkpatrick ..... 219/201
5,638,694 A * 6/1997 Banicevic ..... 62/277
6,862,891 B2 * 3/2005 Devos ..... 62/80
2007/0000271 A1 * 1/2007 Lee et al. ..... 62/276
2007/0186576 A1 * 8/2007 Lee et al. ..... 62/353
2009/0038330 A1 * 2/2009 Lee et al. ..... 62/344

FOREIGN PATENT DOCUMENTS

EP 2083232 A2 * 7/2009 ..... F25D 23/02
JP 2003021452 A * 1/2003 ..... F25D 23/04
KR 1999017486 A 3/1999
KR 10-0853681 * 12/2003 ..... F25D 29/00
KR 2004-062789 * 7/2004 ..... F25D 11/02
KR 853681 B1 8/2008
KR 2008109144 A 12/2008

OTHER PUBLICATIONS

International Search Report & Written Opinion issued in Application No. PCT/KR2010/000299, mailed Jun. 9, 2010, 14 pages.

* cited by examiner

*Primary Examiner* — Frantz Jules
*Assistant Examiner* — Joseph Trpisovsky
(74) *Attorney, Agent, or Firm* — Fish & Richardson P.C.

(57) ABSTRACT

Disclosed is a refrigerator that includes a main body having a cooling chamber. The refrigerator also includes a door coupled to the main body and configured to open and close the cooling chamber. The refrigerator further includes a home bar positioned at a front surface of the door and configured to provide access to contents of the refrigerator without opening the door. In addition, the refrigerator includes a heater positioned at the home bar and configured to adjust an amount of heat based on an ambient temperature.

17 Claims, 7 Drawing Sheets

REFRIGERATOR HAVING A VARIABLE CAPACITY HEATER

CROSS-REFERENCE TO RELATED APPLICATIONS

The present application claims the benefit of priority to Korean Application No. 10-2009-0007748, filed on Jan. 30, 2009, the contents of which is incorporated by reference herein in its entirety.

FIELD

The present disclosure relates to a refrigerator.

BACKGROUND

A refrigerator is a device for keeping groceries (e.g., foods) in a fresh or frozen state. Such refrigerator includes a refrigerator main body having a cooling chamber therein, doors for opening and closing the cooling chamber and a refrigerating cycle device for providing cool air into the cooling chamber.

The refrigerating cycle device includes a compressor for compressing a refrigerant, a condenser for condensing a refrigerant by emitting heat, an expansion apparatus for depressurizing and expanding the refrigerant, and an evaporator for evaporating the refrigerant by making the refrigerant absorb peripheral latent heat.

The refrigerator may have a variety of functions for enhancing user's convenience and satisfaction.

As an example, the refrigerator may have an ice making system or apparatus for making and providing ice cubes.

The ice making system may include an ice maker for making ice cubes, and an ice bank located below the ice maker for storing the ice cubes made by the ice maker.

The ice maker may be positioned inside the door or inside a freezing chamber. Also, an ice making chamber for accommodating the ice maker may be positioned in the door or in the freezing chamber.

A dispenser for exhausting ice and/or water without opening the door may be positioned at the door of the refrigerator.

Also, a home bar for allowing a user to take foods out of the refrigerator without opening the door may be mounted at the door of the refrigerator.

The home bar may have a home bar case coupled to the door and forming an accommodation space having a front surface open, and a home bar door for opening and closing the front opening of the home bar case.

The refrigerator may cause so-called dew condensation that a surface of the refrigerator main body and/or door is cooled by cool air and droplets are condensed on the cooled surface.

The refrigerator employs an electric heater for reducing the dew condensation, causing an increase in power consumption.

SUMMARY

A refrigerator includes a main body having a cooling chamber. The refrigerator also includes a door coupled to the main body and configured to open and close the cooling chamber. The refrigerator further includes a home bar positioned at a front surface of the door and configured to provide access to contents of the refrigerator without opening the door. In addition, the refrigerator includes a heater positioned at the home bar, and configured to adjust an amount of heat based on an ambient temperature.

Implementations may include one or more of the following features. For example, the heater comprises a positive temperature coefficient (PTC) device. The home bar comprises a case having an accommodating space and a home bar door configured to open and close the front opening of the home bar. The heater further includes a heat generator connected to the PTC device. The heat generator is configured to generate heat regardless of the ambient temperature.

In some implementations, the heater further includes a heat conduction unit configured to contact with the PTC device. The heater comprises a variable capacity heater. The heater is configured to determine if the ambient temperature rises, the amount of the heat being decreased when the ambient temperature rises. The home bar comprises a refrigerating chamber home bar and a freeze chamber home bar.

In another aspect a refrigerator includes a main body having a cooling chamber. The refrigerator also includes a door coupled to the main body, positioned at a front surface of the refrigerator and configured to open and close the cooling chamber. The refrigerator further includes a home bar positioned at the door and configured to provide access to contents of the refrigerator without opening the door. In addition, the refrigerator includes a heater having at least one heat generator, positioned at the home bar and configured to generate heat based on an ambient temperature.

In yet another aspect, a refrigerator includes a main body having an outer case that is configured to define an outer appearance and an inner case that is positioned inside of the outer case. The refrigerator also includes a cool air passage positioned between the outer case and the inner case configured to establish a defined and restricted air flow that extends at least partially between a freeze chamber and an ice making chamber. The refrigerator further includes a heater positioned between the outer case and an outer surface of the cool air passage and configured to detect an ambient temperature and generate heat variably depending on the ambient temperature.

DETAILED DESCRIPTION

Figure 1:
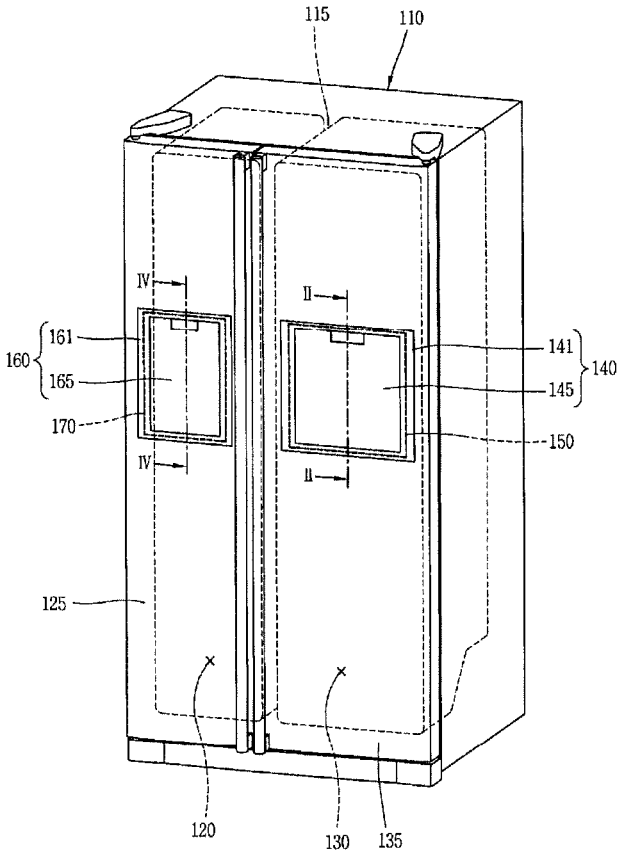
FIG. 1 is a perspective view of a refrigerator having a heater.

As shown in FIG. 1, a refrigerator may include a refrigerator main body 110 having a cooling chamber therein, a door 135 or 125 for opening and closing the cooling chamber, and a heater 150 or 170 positioned in at least one of the refrigerator main body 110 and the door, for generating a different amount of heat depending on an ambient temperature.

The cooling chamber may have both freezing chamber and refrigerating chamber. Alternatively, the refrigerator main body 110 may have one of the freezing chamber and the refrigerating chamber. Hereinafter, an implementation will be described under a situation that the refrigerator main body 110 has a freezing chamber 120 and a refrigerating chamber 130 horizontally positioned with a barrier 115 interposed there between will be described.

The freezing chamber 120 and the refrigerating chamber 130 having a barrier 115 interposed there between in a vertical direction may be positioned inside of the refrigerator main body 110. A freezing chamber door 125 for opening and closing the freezing chamber 120 may be positioned at a front surface of the freezing chamber 120, and a refrigerating chamber door 135 for opening and closing the refrigerating chamber 130 may be positioned at a front surface of the refrigerating chamber 130.

The refrigerating chamber door 135 may have a refrigerating chamber home bar 140 for taking out and/or keeping foods without opening the refrigerating chamber 130.

Figure 2:
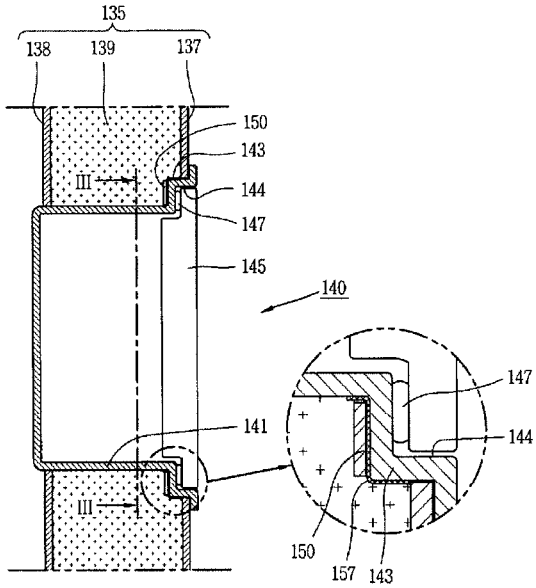
FIG. 2 is a cross-sectional view of FIG. 1.

Referring to FIG. 2, each of the refrigerating chamber door 135 and the freezing chamber door 125 may include an outer plate 137 defining an outer appearance, an inner plate 138 positioned inside of the outer plate 137 with being spaced apart from each other, and an insulating material 139 filled in a space between the outer plate 137 and the inner plate 138. A through section through which the inside of the refrigerating chamber door 135 and the outside thereof communicate with each other for configuring the refrigerating chamber home bar 140 may be positioned at a central area of the refrigerating chamber door 135.

The refrigerating chamber home bar 140 may include a case 141 having an accommodation space therein, and a home bar door 145 positioned at the front surface of the case 141 for opening and closing the front opening of the case 141. A body of the case 141 may have a shape of approximately rectangular box. A flange 143 protruded outwardly and extending in a peripheral direction may be defined at the front surface of the case 141. The flange 143 may be configured to be exposed to the front surface of the refrigerating chamber door 135.

A home bar door accommodation portion 144 for accommodating the home bar door 145 may be positioned at the front surface region of the case 141. The home bar door 145 may have a rectangular shape and be configured such that its four edges are accommodated in the home bar door accommodation portion 144. The home bar door 145 may be rotatable with respect to the case 141. Hinge portions (not shown) for allowing the vertical rotation of the home bar door 145 may be positioned at both sides of a lower end of the home bar door 145. A home bar gasket 147 for firmly blocking the inside of the home bar 140 from the outside thereof may be positioned at an inter-contact section between the case 141 and the home bar door 145.

Further, the heater may be positioned in the home bar 140. The heater 150 has variable capacities such that an mount of heat is determined based on an ambient temperature.

Figure 3:
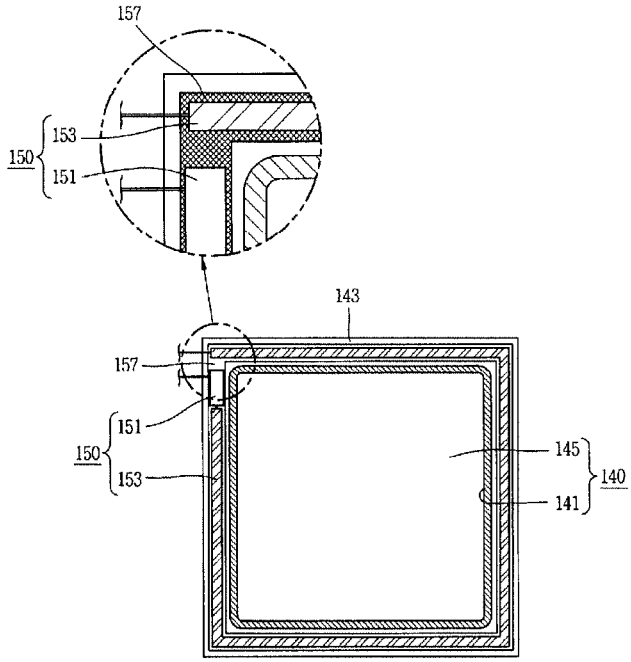
FIG. 3 is a cross-sectional view of FIG. 2.
Figure 4:
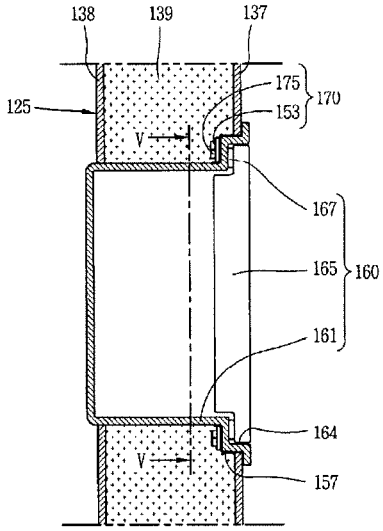
FIG. 4 is a cross-sectional view of FIG. 1.
Figure 5:
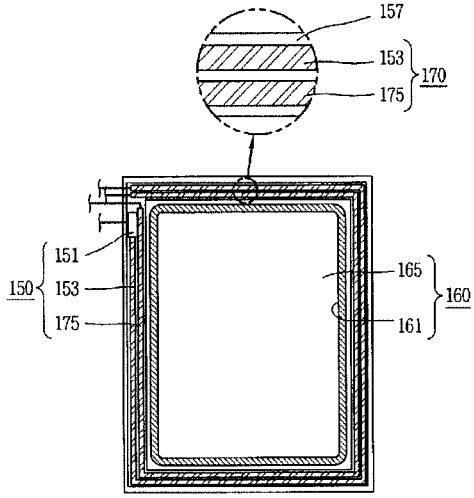
FIG. 5 is a cross-sectional of FIG. 4.

For example, the variable capacity heater 150 of the refrigerating chamber door 140 (hereinafter, referred to as 'variable capacity heater 150') may be configured to generate a small amount of heat when the ambient temperature of the home bar 140 is relatively high. Also, the heater 150 may generate a large amount of heat when the ambient temperature is relatively low. The ambient temperature may be determined based on compared an ambient temperature with a reference temperature As an example, as shown FIG. 3, the variable capacity heater 150 may be have a positive temperature coefficient (PTC) device 151. The PTC device 151 is barium titanate based ceramic, which is a type of semiconductor device in which an electric resistance is increased when a temperature is risen. Hence, upon an ambient temperature being risen, the electric resistance is increased, and a amount of heat is decreased. Therefore, an amount of the heat is adjusted based on detecting change of the temperature. Here, the variable capacity heater 150 may have a plurality of PTC devices 151 as a heat generator or heat emitter.

Alternatively, the variable capacity heater 150 may further include a heat generator 153 made of a typical heating material (e.g., nicrome wire) which generates heat (resistance) regardless of the ambient temperature. In this case, is the number of the PTC devices 151 requiring relatively high cost can be reduced, so as to implement the variable capacity heater 150 with relatively low cost.

As an example, the PTC device 151 and the heat generator 153 may be serially connected. Thus, if the resistance of the PTC device 151 is increased as an ambient temperature is risen, an amount of current flowing over the PTC zo device 151 and the heat generator 153 is decreased. Accordingly, power consumption may be reduced.

A heat conduction unit 157 contacts with the PTC device 151 and the heat generator 153 may be positioned at the case 141. The heat conduction unit 157 allows heat to be transferred from the PTC device 151 and the heat generator 153 to the case 141. A surface temperature of the case 141 may be maintained. As some examples, the heat conduction unit 157 may be configured to have an adhesive layer (material). The heat conduction unit 157 may be configured to have an aluminum tape (sheet or film), so it can be attached to the case 141.

Further, the heat conduction unit 157 may be positioned at a region where the dew condensation on the case 141 occurs. Hence, the installation of the variable capacity heater 150 can be more facilitated without employing a heat generator (heat emitter) at the region where the dew condensation occurs.

Also, heat of the variable capacity heater 150 can be transferred to the case 141 via the heat conduction unit 157, in spite of a curved section of the front surface portion of the case 141, to thereby maintain a uniform temperature at the surface of the case 141.

In addition, the freezing chamber door 125 may have a freezing chamber home bar 160 allowing a user to take ice, foods, or the like out of the home bar 160 without opening the freezing chamber 120. The freezing chamber home bar 160 may include a case 161 having an accommodation space therein, and a home bar door 165 positioned at a front surface of the case 161 for opening and closing the front opening of the case 161. The case 161 may be defined in a rectangular shape. A home bar door accommodation portion 164 for accommodating the home bar door 165 may be positioned at a front surface area of the case 161. The home bar door 165 may be rotated in a vertical direction by a hinge positioned at a lower end thereof. A home bar gasket for blocking the inside of the home bar 160 from the outside thereof may be positioned at an inter-contact section between the case 161 and the home bar door 165.

A variable capacity heater 170 of which heat adjustment depends on an ambient temperature may be positioned in the freezing chamber home bar 160. Hence, dew condensation that moisture in the air is condensed in the freezing chamber home bar 160 can be reduced.

The variable capacity heater 170 of the freezing chamber home bar 160 may have a PTC device 151. Here, the PTC device 151 may be configured, by considering the ambient temperature based on an installation environment of the refrigerator main body, to make an electric resistance increase at a temperature around an ambient temperature, thereby allowing a small conductive current to flow or a current to rarely flow.

The variable capacity heater 170 may have the heat generator (or heat generation unit) 153 serially connected to the PTC device 151. Here, the heat generator 153 may be made of a heating material (e.g., nicrome wire) which generates heat (resistance) regardless of an ambient temperature. Accordingly, the number of PTC devices 151 can be reduced and the heat generation of each of the PTC device 151 and the heat generator 153 may be adjusted based on the ambient temperature.

Alternatively, the variable capacity heater 170 may further have a additional heat generator 175 connected in parallel to the PTC device 151 and made of a heating material (e.g., nicrome wire) which generates heat (resistance) regardless of an ambient temperature. Accordingly, the volume of the PTC device 151 can be further decreased, to reduce the fabricating cost of the variable capacity heater 170.

The case 161 of the freezing chamber home bar 160 may have a heat conduction unit 157 which contacts with the variable capacity heater 170. Thus, heat can be transferred from the variable capacity heater 170 to the case 161 and also the surface temperature of the case 161 can be maintained.

Hereinafter, the operation effects of the variable heaters 150 and 170 positioned in the refrigerating chamber home bar 140 and the freezing chamber home bar 160, respectively, will be described.

With the configuration of the variable capacity heater 150 of the refrigerating chamber home bar 140, in the state of the home bar door 145 being closed, if the ambient temperature is risen, the resistance of the PTC device 151 is increased. A small current then flows over the PTC device 151 and the heat generator 153. Accordingly the heat generation of the variable capacity heater 150 of the refrigerating chamber home bar 140 is decreased. Power consumed by the variable capacity heater 150 of the refrigerating chamber home bar 140 is reduced.

When the home bar door 145 of the refrigerating chamber home bar 140 is open, the surface temperature of the case 141 is dropped due to contact with internal cool air. Here, since less electric resistance is generated by the PTC device 151 and thereby the amount of current flowing over the PTC device 151 and the heat generator 153 is increased, the heat generation in the PTC device 151 and the heat generator 153 is increased. Accordingly, the surface temperature of the case 141 is risen to reduce moisture in the air from being condensed on the surface of the case 141. The heat conduction unit 157 can transfer heat from the variable capacity heater 150 to the case 141 and also allows the surface temperature of the case 141 to be maintained.

Further, with the configuration of the variable capacity heater 170 of the freezing chamber home bar 160, in the state of the home bar door 165 being closed, if the ambient temperature is risen, the electric resistance of the PTC device 151 is increased. The variable capacity heater 170 of the freezing chamber home bar 160 makes current rarely flow or delicately flow over the PTC device 151 and the first heater 153, and allows the additional heat generator 175 to generate heat. Here, the heat of the additional heat generator 175 is diffused (conducted) around the case 161 by the heat conduction unit 157, thereby enabling the surface temperature of the case 161 to be maintained.

If the home bar door 165 is open and thus the ambient temperature is lowered due to interior cool air in the variable capacity heater 170 of the freezing chamber home bar 160, since the electric resistance of the PTC device 151 is decreased, the amount of conductive current flowing over each of the PTC device 151 and the heat generator 153 is increased. The heat generation of the variable capacity heater 170 can be increased. Hence, the dew condensation on the surface of the case 161 can be prevented.

Hereinafter, another implementation of the present invention will be described with reference to FIGS. 6 to 9.

Figure 6:
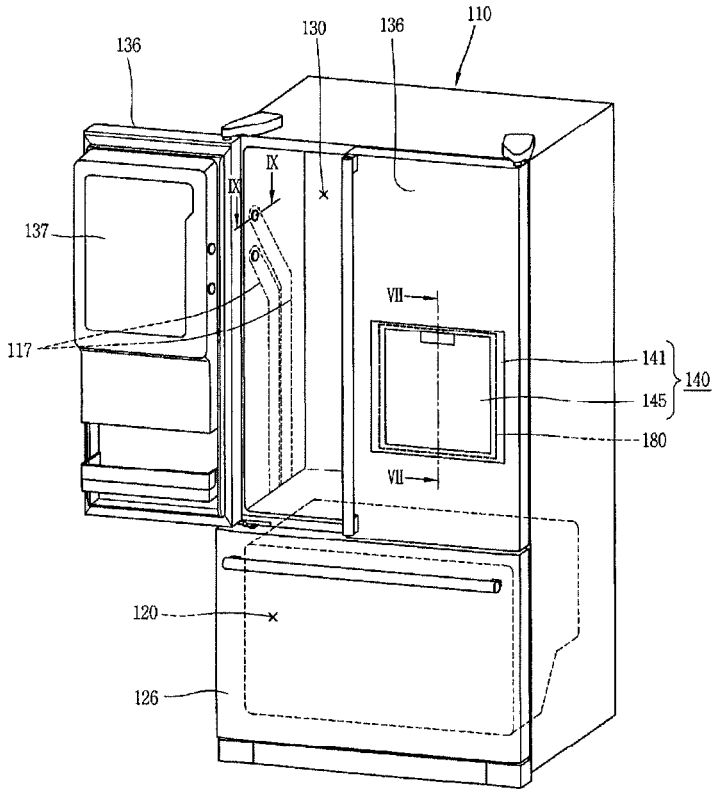
FIG. 6 is a perspective view of a refrigerator having a heater.
Figure 7:
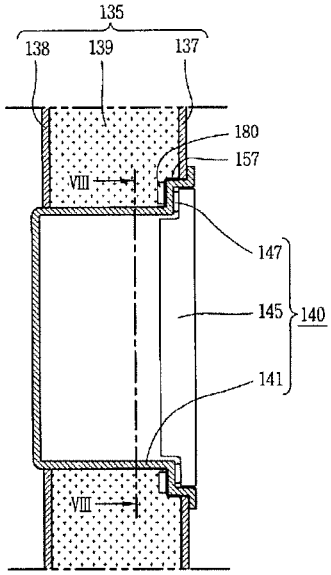
FIG. 7 is a cross-sectional view of FIG. 6.

As shown in FIG. 6, a refrigerator may include a refrigerator main body 110 having a cooling chamber therein, a door for opening and closing the cooling chamber, and a variable capacity heater 180 positioned in at least one of the refrigerator main body 110 and the door, and configured to generate heat variably depending on an ambient temperature. Here, the cooling chamber denotes both freezing chamber and refrigerating chamber. The refrigerator main body 110 may have one of the freezing chamber 120 and the refrigerating chamber. Hereinafter, an implementation in which the refrigerator main body 110 has a configuration with a refrigerating chamber positioned at an upper region and a freezing chamber positioned at a lower region will be described.

A refrigerating chamber 130 is positioned at the upper region of the refrigerator main body 110, and the freezing chamber 120 is positioned at the lower region of the refrigerator main body 110. A pair of refrigerating chamber doors 136 for opening and closing the refrigerating chamber 130 may be positioned at the front surface of the refrigerating chamber 130. The refrigerating chamber doors 136 may be coupled to the refrigerator main body 110. The freezing chamber 120 may have a freezing chamber door 126 implemented as a to type of drawer for opening and closing the freezing chamber 120 with being slid in a back-and-forth direction of the refrigerator main body 110.

One of the refrigerating chamber doors 136 may have a home bar 140. The home bar 140 may include a case 141 having an accommodation space therein, and a home bar door 145 positioned at a front surface of the case 141 for opening and closing an opening of the front surface of the case 141. A home bar gasket 147 may be positioned between the case 141 and the home bar door 145.

A variable capacity heater 180 of which heat generation depends on an ambient temperature may be positioned in the home bar 140. The variable capacity heater 180 may have a plurality of PTC devices 151.

Figure 8:
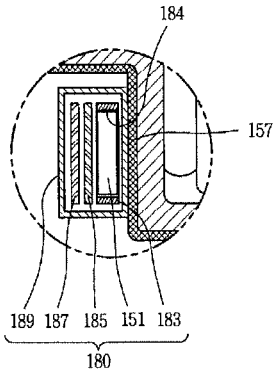
FIG. 8 is an enlarged sectional view of a heater area of FIG. 7.

The variable capacity heater 180, as shown in FIG. 8, may include a plurality of PTC devices 151, a frame 183 in which the PTC devices 151 are accommodated and coupled, a terminal unit 185 for supplying power to the PTC devices 151, an insulating unit 187 for insulating the terminal unit 185, and a load unit 189 implemented as a heat conductor for transferring heat of the PTC devices 151.

The load unit 189 may be defined in a shape of a rectangular tube. The frame 183 may have a length longer than that of the PTC device 151. A plurality of accommodation portions 184 for accommodating the PTC devices 151 may be positioned at the frame 183. The frame 183, the PTC devices 151, the terminal unit 185 and the insulating unit 187 may be accommodated in the load unit 189.

With such configuration, when power is applied to the PTC devices 151 via the terminal unit 185, the PTC devices 151 generate heat, and the generated to heat is transferred to the exterior via the load unit 189.

Further, an ice making chamber 137 in which ice is made may be positioned at another one of the refrigerating chamber doors 136. A side wall cool air passage 117 for providing cool air into the ice making chamber 137 may be positioned in one side wall of the refrigerating chamber 130.

The side wall cool air passage 117 may communicate with the freezing chamber 120. The side wall cool air passage 117 may be configured in pair. Cool air of the freezing chamber 120 flows into the ice making chamber 137 via one of the side wall cool air passages 117 and the cool air flowed through the ice making chamber 137 flows back into the freezing chamber 120 via another one of the side wall cool air passages 117.

Figure 9:
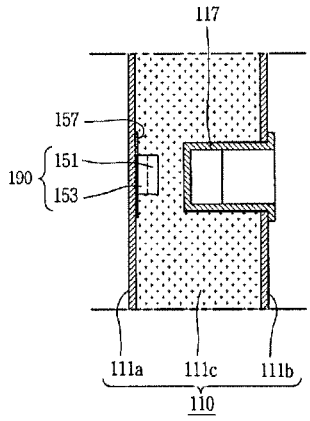
FIG. 9 is an enlarged sectional view of FIG. 6.

The refrigerator main body 110, as shown in FIG. 9, may include an outer case 111*a* forming an outer appearance, an inner case 111*b* positioned inside the outer case 111*a* with being spaced from each other, and an insulating material (foaming agent) 111*c* filled (foamed) for insulation in a space between the outer case 111*a* and the inner case 111*b*.

The side wall cool air passage 117 may be positioned between the outer case 111*a* and the inner case 111*b*, and the insulating material 111*c* may cover the periphery of the side wall cool air passage 117.

A variable capacity heater 190 may be positioned at an outer side of the side wall cool air passage 117, and configured to reduce the dew condensation on the outer surface of the refrigerator main body 110 and also configured to generate or adjust heat variably depending on an ambient temperature. Accordingly, the dew condensation, which occurs on the surface of the outer case 111*a* upon being cooled by the side wall cool air passage 117, can be to reduced.

The variable capacity heater 190 may have the plurality of PTC devices 151. The variable capacity heater 190 may further have a heat generator 153 made of a heating material which generates heat (resistance) regardless of an ambient temperature.

The variable capacity heater 190 may be positioned inside the outer case 111*a*, such that it can reduce droplets from being defined on the surface of the refrigerator main body 110 without spoiling the outer appearance of the refrigerator main body 110.

A heat conduction unit 157 may further be positioned at an inner surface of the outer case 111*a*, such that heat can be transferred from the variable capacity heater 190 to the surface of the outer case 111*a*. The surface temperature of the outer case 111*a* can be maintained.

Hereinafter, the operation effects of the variable capacity heaters 180 and 190 positioned in the home bar 140 and the refrigerator main body 110, respectively, will be described.

In a state of the home bar door 145 of the refrigerating chamber door 136 being closed, if the ambient temperature of the home bar 140 is risen, the electric resistance of the PTC devices 151 is increased and thus less conductive current flows in the variable capacity heater 180 of the home bar 140. Accordingly, the heat generation of the variable capacity heater 180 is decreased and power consumption is reduced.

When the home bar door 145 is open and thereby the surface temperature of the case 141 of the home bar 140 is lowered due to interior cool air, the electric resistance of the PTC devices 151 is decreased. More conductive current then flows in the PTC devices 151, so the heat generation of the variable heater 180 is increased. As a result, the surface temperature of the case 141 is risen to reduce the dew condensation on the surface of the case 141.

Further, if the operation of the ice making chamber 137 is stopped, for example, if the surface temperature of the outer case 111*a* outside the side wall cool air passage 117 is risen, the electric resistance of the PTC devices 151 is increased, and thus less conductive current flows over the PTC devices 151 and the heater 153. As a result, the dew condensation can be reduced.

If the operation of the ice making chamber 137 is started and cool air then flows into the side wall cool air passages 117, the ambient temperature of the PTC devices 151 of the variable capacity heater 190 of the refrigerator main body 110 is lowered, which decreases the electric resistance of the PTC devices 151. Accordingly, a large conductive current flows over the PTC devices 151 and the heat generator 153 and thus the heat generation of the variable capacity heater 190 is increased. Thus, the surface temperature of the outer case 111*a* is risen, thereby reducing the dew condensation due to the cooling of the surface of the outer case 111*a*.

The implementation described with reference to FIGS. 6 to 9 exemplarily shows a variable capacity heater is configured by positioning a plurality of PTC devices at a periphery of a home bar. The implementation as described with reference to FIGS. 1 to 5 that a variable capacity heater is positioned at a home bar or a refrigerator main body may be applicable.

It will be understood that various modifications may be made without departing from the spirit and scope of the claims. For example, advantageous to results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator having a heater, comprising:

a main body having a cooling chamber;

a door coupled to the main body and configured to open and close the cooling chamber;

a home bar positioned at a front surface of the door and configured to enable access to contents of the refrigerator without opening the door; and a heater positioned at the home bar, and configured to adjust an amount of heat based on an ambient temperature, wherein the home bar comprises:

a case having an accommodating space;

a home bar door configured to open and close a front opening of the home bar;

and a home bar door gasket disposed at a contact section between the case and the home bar door, wherein the case defines a home bar door accommodating portion at a front opening of the case, the home bar door accommodating portion accommodating the home bar door when the home bar door is in a closed position, wherein the home bar door gasket contacts an outer surface of the home bar door accommodation portion, wherein the heater comprises a positive temperature coefficient (PTC) device, and a heat generator connected to the PTC device, the heat generator having a first heat generator connected to the PTC device in series and a second heat generator connected in parallel with the PTC device, wherein the heater further comprises a heat conduction unit configured to contact the PTC device, the heat conduction unit being positioned at an inner surface of the home bar door accommodating portion of the case to allow heat of the PTC device to be transferred to the case so as to maintain a temperature of a portion of the case contacting the heat conduction unit, wherein the first and second heat generators are disposed on the heat conduction unit and spaced from each other, wherein the first heat generator and the second heat generator both surround the accommodating space defined by the case of the home bar, and wherein the second heat generator is positioned inside of the first heat generator and located closer to the accommodating space than the first heat generator.

2. The refrigerator of claim 1, wherein the heat generator is configured to generate heat regardless of the ambient temperature.

3. The refrigerator of claim 1, wherein the heater is configured to determine if the ambient temperature rises, the amount of the heat being decreased when the ambient temperature rises.

4. The refrigerator of claim 1, wherein the home bar comprises a refrigerating chamber home bar and a freeze chamber home bar.

5. A refrigerator having a heater, comprising:

a main body having a cooling chamber;

a door coupled to the main body, positioned at a front surface of the refrigerator and configured to open and close the cooling chamber;

a home bar positioned at the door and configured to enable access to contents of the refrigerator without opening the door; and a heater having at least one heat generator, positioned at the home bar and configured to generate heat based on an ambient temperature, wherein the home bar comprises:

a case having an accommodating space; and a home bar door configured to open and close a front opening of the home bar; and a home bar door gasket disposed at a contact section between the case and the home bar door, wherein the case defines a home bar door accommodating portion at a front opening of the case, the home bar door accommodating portion accommodating the home bar door when the home bar door is in a closed position, wherein the home bar door gasket contacts an outer surface of the home bar door accommodation portion, wherein the heater comprises a positive temperature coefficient (PTC) device, wherein the at least one heat generator comprises a first heat generator connected to the PTC device in series and a second heat generator connected in parallel with the PTC device, wherein the heater further comprises a heat conduction unit configured to contact with the PTC device, the heat conduction unit being positioned at an inner surface of the home bar door accommodating portion of the case to allow heat of the PTC device to be transferred to the case so as to maintain a temperature of a portion of the case contacting the heat conduction unit, wherein the first and second heat generators are disposed on the heat conduction unit and spaced from each other, wherein the first heat generator and the second heat generator both surround the accommodating space defined by the case of the home bar, and wherein the second heat generator is positioned inside of the first heat generator and located closer to the accommodating space than the first heat generator.

6. The refrigerator of claim 5, wherein the home bar comprises a refrigerating chamber home bar and a freeze chamber home bar.

7. A refrigerator having a heater, comprising:

a main body having an outer case that is configured to define an outer appearance and an inner case that is positioned inside of the outer case, the main body comprising a freezing chamber disposed at a lower portion of the main body and a refrigerating chamber disposed at an upper portion of the main body;

a refrigerating chamber door configured to open and close the refrigerating chamber;

an ice chamber located at the refrigerating chamber door and configured to store ice;

a cool air passage positioned between the outer case and the inner case configured to establish a defined and restricted air flow that extends at least partially between the freezing chamber and the ice chamber; and a heater positioned between the outer case and an outer surface of the cool air passage and configured to detect an ambient temperature and generate heat variably depending on the detected ambient temperature, wherein the heater comprises a positive temperature coefficient (PTC) device, and a heat generator connected to the PTC device, the heat generator having a first heat generator connected to the PTC device in series and a second heat generator connected in parallel with the PTC device, wherein the heater further comprises a heat conduction unit configured to contact with the PTC device, the heat conduction unit being positioned at an inner surface of the outer case to allow heat of the PTC device to transfer to the outer case so as to maintain a temperature of a portion of the outer case contacting the heat conduction unit, wherein the first and second heat generators are disposed on the heat conduction unit and spaced from each other, wherein the first heat generator and the second heat generator both surround the accommodating space defined by the case of the home bar, and wherein the second heat generator is positioned inside of the first heat generator and located closer to the accommodating space than the first heat generator.

8. The refrigerator of claim 7, wherein further comprises an insulating material positioned between the outer case and inner case.

9. The refrigerator of claim 1, wherein the first heat generator is a nicrome wire and the second heat generator is a nicrome wire.

10. The refrigerator of claim 1, wherein the first heat generator follows a path that is parallel to a path followed by the second heat generator.

11. The refrigerator of claim 1, wherein a spacing between the first heat generator and the second heat generator is maintained as the first heat generator and the second heat generator surround the accommodating space defined by the case of the home bar.

12. The refrigerator of claim 5, wherein the first heat generator is a nicrome wire and the second heat generator is a nicrome wire.

13. The refrigerator of claim 5, wherein the first heat generator follows a path that is parallel to a path followed by the second heat generator.

14. The refrigerator of claim 5, wherein a spacing between the first heat generator and the second heat generator is maintained as the first heat generator and the second heat generator surround the accommodating space defined by the case of the home bar.

15. The refrigerator of claim 7, wherein the first heat generator follows a path that is parallel to a path followed by the second heat generator.

16. The refrigerator of claim 7, wherein the first heat generator and the second heat generator both surround the accommodating space defined by the case of the home bar.

17. The refrigerator of claim 7, wherein a spacing between the first heat generator and the second heat generator is maintained as the first heat generator and the second heat generator surround the accommodating space defined by the case of the home bar.

* * * * *